US006058360A

United States Patent [19]

Bergström

[11] Patent Number: 6,058,360

[45] Date of Patent: May 2, 2000

[54] POSTFILTERING AUDIO SIGNALS ESPECIALLY SPEECH SIGNALS

[75] Inventor: Rolf Anders Bergström, Mölndal, Sweden

[73] Assignee: Telefonaktiebolaget LM Ericsson, Stockholm, Sweden

[21] Appl. No.: 08/953,919

[22] Filed: Oct. 20, 1997

[30] Foreign Application Priority Data

Oct. 30, 1996 [DE] Germany ..... 196 43 900

[51] Int. Cl.[7] ..... G10L 9/14

[52] U.S. Cl. ..... 704/219; 704/502

[58] Field of Search ..... 704/219, 222, 704/223, 200, 500, 501, 502

[56] References Cited

U.S. PATENT DOCUMENTS

| | | | |
|---|---|---|---|
| 4,301,329 | 11/1981 | Taguchi | 704/219 |
| 4,381,561 | 4/1983 | Treiber | 370/24 |
| 4,472,832 | 9/1984 | Atal et al. | 704/219 |
| 4,475,227 | 10/1984 | Belfield | 704/212 |
| 4,617,676 | 10/1986 | Jayant et al. | 375/27 |
| 4,617,677 | 10/1986 | Chiba | 375/94 |
| 4,720,861 | 1/1988 | Bertrand | 704/219 |
| 4,726,037 | 2/1988 | Jayant | 375/27 |
| 4,757,517 | 7/1988 | Yatsuzuka | 375/25 |
| 4,817,157 | 3/1989 | Gerson | 704/223 |
| 4,852,169 | 7/1989 | Veeneman et al. | 704/200 |
| 4,969,192 | 11/1990 | Chen et al. | 704/222 |
| 5,241,650 | 8/1993 | Gerson et al. | 704/200 |
| 5,359,696 | 10/1994 | Gerson et al. | 704/223 |
| 5,694,519 | 12/1997 | Chen et al. | 704/228 |

FOREIGN PATENT DOCUMENTS

| | | | |
|---|---|---|---|
| 0 503 684 A2 | 9/1992 | European Pat. Off. | G10L 9/14 |
| 188820 | 11/1922 | United Kingdom . | |
| WO 91/06093 | 5/1991 | WIPO | G10L 9/08 |

OTHER PUBLICATIONS

"Personal Digital Cellular Telecommunication System RCR Standard" RCR STD–27D, Fascicle 1, Research & Development Center for Radio Systems (RCR), Jun. 27, 1995, pp. 668–787.

"Cellular System Dual–Mode Mobile Station—Base Station Compatibility Standard", EIA/TAI Project No. 2215, IS–54, Electronics Industries Association, Dec. 1989, pp. 71–77.

*Primary Examiner*—Richemond Dorvil

*Attorney, Agent, or Firm*—Burns, Doane, Swecker & Mathis, L.L.P.

[57] ABSTRACT

A short-delay postfilter (13) for postfiltering an encoded or decoded audio signal, specifically a speech signal, the short-delay postfilter having a transfer function F(z) of the form F(z)=D(z)/E(z), where E(z) and (D(z) are polynomials dependent on the variable z, where z is the inverse of the unit delay operator $z^{-1}$ used in the z transform representation of transfer functions and wherein the denominator E(z) of the transfer functions H(z) of the audio signal's corresponding production filter (12) is also derived and the numerator D(z) differs from the denominator E(z) and is derived by using a longer period than used for the denominator E(z).

30 Claims, 1 Drawing Sheet

POSTFILTERING AUDIO SIGNALS ESPECIALLY SPEECH SIGNALS

BACKGROUND OF THE INVENTION

This invention relates to postfilters for postfiltering audio signals, especially speech signals and to methods of postfiltering these signals. More specifically, it relates to short-delay postfilters for postfiltering audio signals, especially speech signals and to methods of postfiltering these signals with a short-delay postfilter.

Postfilters are generally used to mask noise in speech signals by enhancing strong spectral parts and/or by suppressing weak regions in the signals. For example, such noise may arise in the case where analogue speech signals are sampled for encoding into a digital representation, as happens before transmission of the speech signals in a mobile telecommunications system, or during subsequent decoding of a previously encoded signal. Very often, such encoding or decoding will also involve compression of the signal data during the encoding procedure, with subsequent decompression, as appropriate, during decoding. The loss of some information contained in original analogue audio signal is therefore inevitable in the case of compression and decompression, and the application of a postfilter to improve the perceived quality of the decoded signals is desirable. A postfilter may be applied to the encoded audio signals, to the decoded audio signals, or to both to achieve this improvement.

Three main types of postfilter may be distinguished. These are known respectively as short-delay (or short-term) postfilters, long-delay (or long-term) postfilters and high-frequency emphasis (or high-pass) postfilters. Short-delay postfilters generally work by enhancing regions of the frequency spectrum of an audio signal in which there is much energy, in order to decrease distortion in the valleys of the frequency spectrum. Long-delay postfilters generally work by enhancing regions of the frequency spectrum showing long-term periodicity corresponding to the pitch or audio frequency of the original signal. High-frequency emphasis postfilters are used to enhance high frequency regions of a signal frequency spectrum, and hence to restore brightness to the signal, since low frequency regions are generally amplified more in relation to high frequency regions during coding and decoding. A high-frequency emphasis postfilter may also be used to compensate for high-frequency losses created by the application of a short-delay postfilter. The three main types of postfilter just described may be applied individually to audio signals, or in a combination of two of the three types of postfilter, or in a combination of all three types together for optimal improvement in the perceived quality of the audio signals.

As mentioned above, the present invention relates specifically to short-delay postfilters and to methods of postfiltering audio signals, especially speech signals with short-delay postfilters. The effect of a short-delay postfilter upon an audio signal may be represented by a transfer function P(z) expressed in terms of filter coefficients and the variable z, where z is the inverse of the unit delay operator $z^{-1}$ used in the z-transform representation of transfer functions. Furthermore, a production filter for generating coded audio signals may be represented by a transfer function H(z) also expressed in terms of filter coefficients and the variable z. As shown in the accompanying figure (FIGURE), in generating a coded audio signal, an excitation generator 11 is used to provide an excitation signal E(z) toga production filter 12. The production filter 12 transforms the excitation signal E(z) into a synthetic audio signal S(z) according to the transfer function H(z) of the production filter. As also shown in the FIGURE, the synthetic audio signal S(z) thus produced may subsequently be supplied, either immediately or following transmission and decoding, to a postfilter 13, which transforms the synthetic audio signal S(z) according to the transfer function P(z) of the postfilter to generate a postfiltered audio signal Sp(z).

The transfer function H(z) of the production filter 12 is often of the type:

$$H(z)=1/A(z) \quad \text{[Eqn. 1]}$$

where A(z) is a polynomial expressible as:

$$A(z) = 1 + \sum_{m=1}^{M_a} a_m z^{-m} \quad \text{[Eqn. 2]}$$

where m is an index ranging from 1 up to $M_a$, the order of the polynomial, $a_m$ are the coefficients of the polynomial and z is the variable, as before. $M_a$, the order of the polynomial, is typically from 8 to 10.

U.S. Pat. No. 4,969,192, assigned to Voicecraft, Inc. of Goleta, Calif., USA, describes using the same polynomial A(z) of Eqn. 2 used in the production filter 12 to provide the denominator and the numerator of a transfer function P(z) for the short-delay postfilter 13. Accordingly, the denominator term of such a transfer function emphasizes the formants in the frequency spectrum of the synthetic audio signal S(z) provided by the production filter, whilst attenuating the valleys in the frequency spectrum, as desired. Being of the same form as the denominator term, the numerator term of such a short-delay transfer function aims to cancel out the overall shape of the frequency spectrum resulting from the denominator term.

In U.S. Pat. No. 4,969,192, the denominator and numerator terms of the short-delay transfer function P(z) are modified from the polynomial A(z) of the corresponding production filter transfer function by respective chirp factors, which are empirically determined parameters, α and β, thus:

$$P(z)=A_P(z/\beta)/A_P(z/\alpha) \quad \text{[Eqn. 3]}$$

where α and β are defined by $0<\alpha<\beta<1$. These chirp factors, α and β, may accordingly be used to move the poles and zeros of the transfer function of Eqn. 3 towards the origin. Setting α or β=1 makes the denominator or numerator term, respectively, the same as A(z), whilst setting α=0 results in an all-pass postfilter. The short-delay transfer function of Eqn. 3 provides some trade-off between spectral peaks so sharp as to produce readily perceptible and hence undesirable chirping and so low as not to achieve any noise reduction at all. U.S. Pat. No. 4,969,192 therefore suggests using values for α and β of α=0.8 and β=0.5 to achieve a compromise between these two extremes, whereby spectral tilt introduced by the denominator term is partially canceled by the numerator term. However, filtered audio signals resulting from the transfer function of Eqn. 3 remain muffled, requiring a high-frequency emphasis filter to compensate for the high-frequency losses introduced by a short-delay postfilter having such a transfer function. Moreover, since the numerator polynomial of Eqn. 3 does not track the denominator polynomial precisely, the overall spectral tilt of the short-delay postfilter wanders over time, producing a perceived variation in the postfiltered signal brightness.

U.S. Pat. No. 5,241,650 assigned to Motorola Inc. of Schaumberg, Ill., attempts to improve upon the short-delay postfilter transfer function of U.S. Pat. No. 4,969,192 described in Eqn. 3, above. The short-delay postfilter transfer function described in U.S. Pat. No. 5,241,650 uses the same denominator term as in the transfer function of the corresponding production filter, but in contrast to U.S. Pat. No. 4,969,192, the numerator term is derived from the denominator term by (a) transforming the denominator term to an alternate domain set of parameters, (b) operating on the alternate domain set of parameters to provide a set of coefficients, and then (c) using this set of coefficients to provide the numerator term. In one embodiment of U.S. Pat. No. 5,241,650, the denominator term is transformed into the autocorrelation domain. In this alternate domain, a spectral smoothing technique making use of a bandwidth expansion function is used to operate on the autocorrelation sequence of the filter coefficients, before the set of coefficients for the numerator term is then provided from the operated-on autocorrelation sequence via the Levinson recursion.

U.S. Pat. No. 5,241,650 describes how the numerator term may alternatively be derived directly from the transfer function of the corresponding production filter via the same procedure, rather than from the denominator term of the short-delay postfilter, but since the denominator term only differs from the polynomial used in the production filter by a chirp factor, the effect is the same. The result in both cases is that the numerator polynomial is a spectrally smoothed version of the denominator polynomial, $Ap(z/\alpha)$.

The short-delay postfilter described in U.S. Pat. No. 5,241,650 is used in the Personal Digital Cellular (PDC) telecommunications system, as described in the PDC telecommunications system RCR standard, "RCR STD-27" of the Research and Development Centre for Radio Systems (RCR) of June 1995. It is also used in mobile telecommunications systems conforming to the IS-54 standard, as described in "Cellular System: Dual-Mode Mobile Station-Base Station Compatibility Standard IS-54" of the Electronic Industries Association (EIA) of December 1989.

Although a short-delay postfilter according to U.S. Pat. No. 5,241,650 improves upon the time-varying spectral tilt of a short-delay postfilter according to U.S. Pat. No. 4,969,192 by providing a numerator polynomial for the short-delay postfilter transfer function which is a spectrally smoothed version of the denominator polynomial therein, the problem still remains that since the numerator term in U.S. Pat. No. 5,241,650 is derived either from the denominator of the same transfer function or from the transfer function of the corresponding production filter, the spectral slope of the postfiltered audio signal may still change too abruptly to eliminate perceptible modulations in the brightness of the postfiltered signal.

SUMMARY OF THE INVENTION

Therefore, an object of the present invention is to provide a short-delay postfilter for improving the perceived quality of encoded or decoded audio signals and to provide a corresponding method of postfiltering encoded or decoded audio signals with a short-delay postfilter, according to which postfiltered audio signals having both improved signal brightness and reduced signal brightness modulation over time are produced.

The object of the invention is solved by the features of the claims 1 and 16.

In one aspect, the present invention provides a short-delay postfilter for postfiltering an encoded or decoded audio having a transfer function F(z) of the form:

$$F(z)=D(z)/E(z) \quad \text{[Eqn. 4]}$$

where E(z) and D(z) are polynomials in the variable z, which is the inverse of the unit delay operator $z^{-1}$ used in the z-transform representation of transfer functions, and wherein the denominator E(z) is derived from the transfer function H(z) of the corresponding production filter of said audio signal and the numerator D(z) differs from the denominator E(z) and is derived using a longer temporal period than for the denominator E(z).

The functions E(z) and D(z) can be polynomials. Further, E(z) and D(z) can be represented by reflection coefficients, line spectral frequencies, logarithmic area ratios and the like.

The lengths of the respective time windows used to derive the functions E(z) and D(z) can be determined from the audio signal. E(z) and D(z) can also be dependent on the allowed spectral fluctuations of the output audio signal. Further, the coefficients of the functions E(z) and D(z) may be fixed values or made dependent on the speech signal, i.e., the coefficients of the functions E(z) and D(z) can computed from the audio signal at predetermined times. Still further, the coefficients of the numerator D(z) can be derived by filtering the parameters of the production filter. For example, the coefficients of the numerator D(z) can be computed by transforming the coefficients of the production filter from a first domain into a second domain, by filtering the transformed coefficients in the second domain and by transforming them back into the first domain.

In another aspect, the present invention provides a method of postfiltering an encoded or decoded audio signal comprising the steps of: providing an encoded or decoded audio signal from a production filter having a transfer function H(z); buffering said audio signal into frames of vectors; filtering said vectors with a short-delay postfilter having a transfer function E(z) of the form:

$$F(z)=D(z)/E(z)$$

where E(z) and D(z) are polynomials, and wherein the denominator polynomial E(z) is the same polynomial as in the transfer function H(z) of the production filter of said audio signal and the numerator polynomial D(z) is a polynomial, which differs from the denominator polynomial E(z) and is derived using a longer temporal period than the denominator polynomial E(z).

BRIEF DESCIRPTION OF THE DRAWINGS

The present invention will now be explained further, referring to the accompanying figure (FIGURE), which schematically shows an arrangement by which an encoded audio signal is generated and subsequently postfiltered.

DETAILED DESCRIPTION

Figure 1:
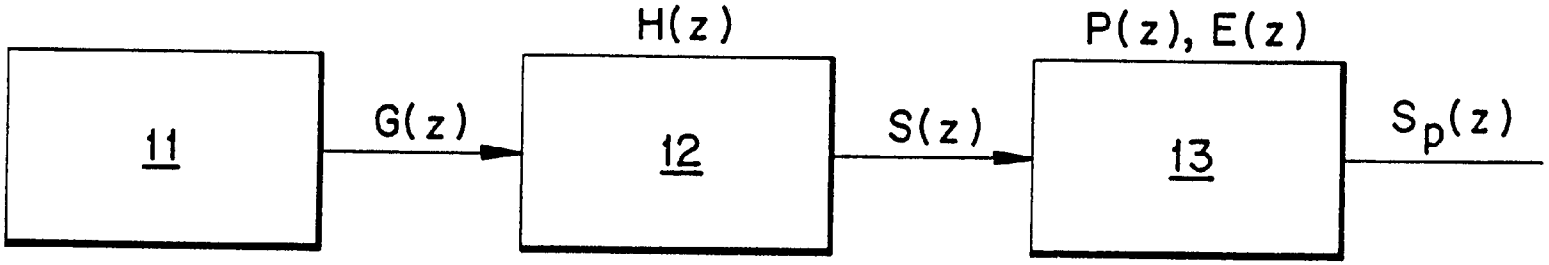

A principle of the present invention is to use a polynomial in the numerator term which differs from the polynomial used in the denominator term of the transfer function of a short-delay postfilter according to the invention. Moreover, the polynomial in the numerator term of this transfer function is derived by using a longer temporal period than for the denominator term, whereby rapid fluctuations in the spectral slope of the postfiltered signal is avoided.

It can be seen, therefore, that since the denominator polynomial E(z) of the transfer function F(z) in a short-delay postfilter according to the present invention is closely related to the transfer function H(z) of the corresponding production filter of the audio signal which is postfiltered, as before, the denominator term will emphasize formants in the frequency spectrum of the audio signal, whilst attenuating valleys in the frequency spectrum, as desired. However, since the numerator polynomial is no longer directly related to the denominator polynomial, it can be chosen best to cancel spectral tilt introduced to the audio signal by the denominator term. Moreover, since the numerator polynomial is derived using a longer temporal period than the denominator polynomial, rapid fluctuations in the brightness of the post-filtered speech are avoided.

The longer temporal period of the numerator term may be achieved in one of several ways. If the numerator term is derived from a buffer of the synthetic speech to be postfiltered, then the longer temporal period may be achieved by using a relatively long data buffer for the numerator (relative to a buffer used for the denominator term), or by an averaging process over frames of vectors in the buffer used for the numerator. However, since the numerator term is not related to the denominator term in the transfer function for the short-delay postfilter, there is no absolute requirement in the present invention that the numerator term should be derived from the audio signal to be postfiltered.

A preferred embodiment of the present invention is to derive the numerator term for use in the transfer function via a linear predictive coding (LPC) analysis of the audio signal to be postfiltered. The signal may be windowed. Alternatively, the covariance/autocorrelation matrix of the signal may be windowed, using normal windows for LPC, and then filtering the filter parameters. Many representations of the parameters are possible.

The overall short-delay postfilter transfer function may be chirped in a similar manner to that described previously, whereby a chirp factor $\alpha$ is introduced into the denominator and the poles of the transfer function are moved towards the origin. In such a case, the transfer function has a form:

$$F(z)=D(z)/E(z/\alpha) \quad \text{[Eqn. 5]}$$

where $\alpha$ is a parameter lying in the interval $0<\alpha<1$. If, in addition, a chirp factor D is introduced into the numerator term, thus:

$$F(z)=D(z/\beta)/E(z/\alpha) \quad \text{[Eqn. 6]}$$

since the numerator and denominator polynomials are no longer directly related, $\alpha$ and $\beta$ may now take identical values in the interval $0<\alpha, \beta<1$, allowing exact cancellation of the spectral tilt introduced by the denominator term by the numerator term.

There is no restriction that a short-delay postfilter according to the present invention should be applied only to an audio signal to be postfiltered. Other representations of the filter coefficients, such as reflection coefficients, may instead be filtered. Correlations between shorter data segments may also be used by applying filtering to a number of shorter data blocks.

A short-delay postfilter according to the present invention may be combined with a long-delay postfilter and/or a high-frequency emphasis filter in cascade to provide a complete postfiltering application. In such cases, the transfer functions of the long-delay postfilter and the high-frequency emphasis filter are calculated as in known applications. This means that the transfer function Q(z) for the long-delay postfilter may, for example, has the form:

$$Q(z)=C_g(1+gz^{-p})/(1-lz^{-p}) \quad \text{[Eqn. 7]}$$

where z has the same meaning as before, the value of p is determined by a pitch analysis of the audio signal, $C_g$ is an adaptive scaling factor, and the coefficients g and l are determined according to the following formulas:

$$g=C_z f(x) \quad \text{[Eqn. 8a]}$$

$$l=C_p f(x) \quad \text{[Eqn. 8b]}$$

where $C_z$ and $C_p$ are fixed scaling factors lying in the interval $0<C_z, C_p<1$, and where:

1 if x>1

$$f(x)=x \text{ if } U_{th}\leqq x\leqq 1 \quad \text{[Eqn. 9]}$$

0 if $x<U_{th}$ where $U_{th}$ is an unvoiced threshold value and x is a voicing indicator parameter which depends on the pitch predictor used for the long-delay postfilter.

The high-frequency emphasis filter for combination with the short-delay postfilter of the present invention may, for example, be a first-order filter having a transfer function R(z) of the form:

$$R(z)=1-u\ z^{-1} \quad \text{[Eqn. 10]}$$

where u is an empirically determined parameter lying in the interval $0<u<1$, and typically having a value of from 0.2 to 0.5.

Thus, if used in combination with a long-delay and/or a high-frequency emphasis postfilter, a short-delay postfilter according to the present invention may be used in a combined postfilter for optimal improvement of the perceived quality of an encoded or decoded audio signal.

It will be understood by those skilled in the art, that various modifications and changes may be made to the present invention without departure from the spirit and scope thereof, which is defined by the appended claims.

I claim:

1. An apparatus for postfiltering an encoded or decoded audio signal, said apparatus comprising:

an input for receiving said encoded or decoded audio signal; and a short-delay postfilter coupled to the input, for filtering the encoded or decoded audio signal and supplying a postfiltered signal at an output, wherein the short-delay postfilter operates according to a transfer function F(z) of the form:

$$F(z)=D(z)/E(z)$$

where E(z) and D(z) are polynomials in the variable z, where z is the inverse of the unit delay operator $z^{-1}$ used in the z-transform representation of transfer functions and wherein:

the denominator E(z) is derived from the transfer function H(z) of a corresponding production filter of said audio signal; and the numerator D(z) is not directly related to the denominator E(z) and is computed by using a longer temporal period than for the denominator E(z).

2. An apparatus according to claim 1, wherein the numerator D(z) is derived from a buffer of the audio signal.

3. An apparatus according to claim 2, wherein the numerator D(z) is derived from said buffer via a linear predictive coding (LPC) analysis.

4. An apparatus according to claim 1, wherein the coefficients of the functions E(z) and D(z) are computed from the audio signal at predetermined times.

5. An apparatus according to claim 1, wherein reflection coefficients are used for representing at least one of the functions E(z) and D(z).

6. An apparatus according to claim 1, wherein at least one of the functions E(z) and D(z) incorporate line spectral frequencies.

7. An apparatus according to claim 1, wherein at least one of the functions E(z) and D(z) incorporate logarithmic area ratios.

8. An apparatus according to claim 1, wherein the coefficients of the numerator D(z) are derived by filtering the parameters of the production filter.

9. An apparatus according to claim 1, wherein the coefficients of the numerator D(z) are computed by transforming the coefficients of the production filter from a first domain into a second domain, by filtering the transformed coefficients in the second domain and by transforming them back into the first domain.

10. An apparatus according to claim 1, wherein the numerator D(z) is calculated in small blocks and thereafter filtered.

11. An apparatus according to claim 1, wherein the audio signal is windowed.

12. An apparatus according to claim 1, wherein a covariance or autocorrelation matrix of the signal is windowed.

13. An apparatus according to claim 1, wherein the transfer function F(z) of the short-delay-postfilter has the form:

$$F(z)=D(z)/E(z/\alpha)$$

where $\alpha$ is a parameter lying in the interval $0<\alpha<1$, and where the transfer function F(z) may be chirped by moving poles of the transfer function towards the origin.

14. An apparatus according to claim 1, wherein the transfer function F(z) of the short-delay postfilter has the form:

$$F(z)=D(z/\beta)/E(z/\alpha)$$

where $\alpha$ and $\beta$ are parameters in the interval $0<\alpha, \beta<1$, and where the transfer function F(z) may be chirped by moving zeros of the transfer function towards the origin.

15. An apparatus according to claim 1, further comprising:

at least one of a long-delay postfilter and a high frequency emphasis filter in series with the short-delay postfilter.

16. A method of postfiltering an encoded or decoded audio signal comprising the steps of:

providing an encoded or decoded audio signal from a production filter, wherein the production filter operates according to a transfer function H(z), where z is the inverse of the unit delay operator $z^{-1}$ used in the z-transform representation of transfer functions;

buffering said audio signal into frames of vectors;

filtering said vectors with a short-delay postfilter, wherein the short-delay postfilter operates according to a transfer function F(z) of the form:

$$F(z)=D(z)/E(z)$$

where E(z) and D(z) are polynomials in z, and wherein:

the denominator E(z) is derived from the transfer function H(z) of the production filter of said audio signal; and the numerator D(z) is not directly related to the denominator E(z) and is computed by using a longer temporal period than for the denominator E(z).

17. A method of postfiltering an audio signal according to claim 16, where the coefficients of the functions E(z) and D(z) are computed from the audio signal at predetermined times.

18. A method of postfiltering an audio signal according to claim 16, where reflection coefficients are used in at least one of the function E(z) and D(z).

19. A method of postfiltering an audio signal according to claim 16, where at least one of the function E(z) and D(z) incorporate line spectral frequencies.

20. A method of postfiltering an audio signal according to claim 16, where at least one of the functions E(z) and D(z) incorporate logarithmic area ratios.

21. A method of postfiltering an audio signal according to claim 16, where the coefficients of the numerator D(z) are derived by filtering the parameters of the production filter.

22. A method of postfiltering an audio signal according to claim 16, where the coefficients of the numerator D(z) are computed by transforming the coefficients of the production filter from a first domain into a second domain, by filtering the transformed coefficients in the second domain and by transforming them back into the first domain.

23. A method of postfiltering an audio signal according to claim 16, wherein the D(z) is calculated in small blocks and thereafter filtered.

24. A method of postfiltering an audio signal according to claim 16, further comprising deriving numerator polynomial $C_P(z)$ from a buffer of the audio signal.

25. A method of postfiltering an audio signal according to claim 24, comprising conducting a linear predictive coding (LPC) analysis to derive the numerator polynomial $C_P(z)$ from said buffer.

26. A method of postfiltering an audio signal according to claim 16, further comprising windowing the audio signal.

27. A method of postfiltering an audio signal according to claim 16, further comprising windowing a covariance or autocorrelation matrix of the audio signal.

28. A method of postfiltering an audio signal according to claim 16, further comprising:

providing the denominator of the transfer function F(z) of the short-delay postfilter with a chirping factor $\alpha$ such that the transfer function F(z) has the form:

$$F(z)=D(z)/E(z/\alpha)$$

where $\alpha$ is a parameter in the interval $0<\alpha<1$; and chirping the transfer function by moving the poles of the transfer function towards the origin.

29. A method of postfiltering an audio signal according to claim 28, further comprising:

providing the numerator of the transfer function F(z) of the short-delay postfilter with a chirping factor $\beta$ such that the transfer function has the form:

$$F(z)=D(z/\beta)/E(z/\alpha)$$

where $\alpha$ and $\beta$ are parameters in the interval $0<\alpha, \beta<1$; and chirping the transfer function by moving the zeros of the transfer function towards the origin.

30. A method of postfiltering an audio signal according to claim 16, further comprising postfiltering the audio signal with at least one of a long-delay postfilter and a high-frequency emphasis filter.

* * * * *